United States Patent [19]
Walters
[11] 4,210,838
[45] Jul. 1, 1980

[54] GAS DISCHARGE DISPLAY PANEL

[75] Inventor: Frank Walters, Bury, England
[73] Assignee: Ferranti Limited, Hollinwood, England

[21] Appl. No.: 933,570
[22] Filed: Aug. 14, 1978
[30] Foreign Application Priority Data
Aug. 25, 1977 [GB] United Kingdom ..... 35726/77
[51] Int. Cl.[2] ..... H01J 61/04; H01J 61/30; H01J 61/54
[52] U.S. Cl. ..... 313/198; 313/217; 313/220
[58] Field of Search ..... 313/217, 220, 198

[56] References Cited

U.S. PATENT DOCUMENTS 3,701,918 10/1972 Allen et al. ..... 313/217 X
3,798,483 3/1974 Walters ..... 313/217 X
3,868,543 2/1975 Holz et al. ..... 315/169 TV X
3,886,395 5/1975 Eukushima et al. ..... 313/198 X

*Primary Examiner*—Palmer C. Demeo
*Attorney, Agent, or Firm*—Kerkam, Stowell, Kondracki & Clarke

[57] ABSTRACT

In a gas discharge display panel consisting of a matrix of discharge cells defined by gas filled cavities in a block and having cathodes formed by sets of conductors on an end plate sealing the cavities and in which the matrix includes priming cells which are energized to provide from their discharge UV radiation to prime the other cells of the display, at least some of the conductors, except where they form cathodes of the priming cells, are thickened to space the end plate from the block and permit penetration of the UV radiation to the conductors at the ends of the other cavities.

7 Claims, 7 Drawing Figures

GAS DISCHARGE DISPLAY PANEL

Figure 1:
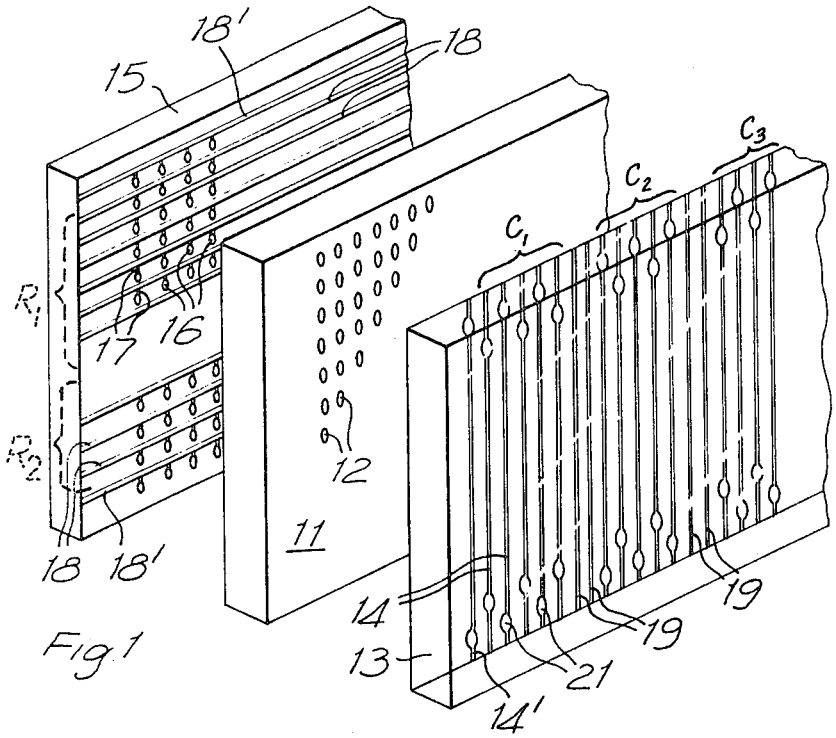

This invention relates to gas discharge display panels including an array of cold-cathode direct current discharge devices each of which may be struck or extinguished to produce a display of the required form.

It is known from British Pat. No. 1,326,384 to produce a gas discharge display panel including a plurality of discharge cells comprising a block of electrically insulating material containing a plurality of gas filled cavities arranged in the rows and columns of a two-coordinate rectangular array, a first set of electrical conductors adjacent one end of the cavities and in contact with the discharge space, each conductor of the set forming first electrodes of those cells associated with a unique value of one coordinate of the array, a plurality of second electrodes each being located adjacent the other end of an individual cavity and in contact with the discharge gas, a plurality of electrically resistive elements each of which is connected to a different second electrode, and a second set of electrical conductors, each conductor of the second set interconnecting the resistive element of the cells associated with a unique value of the other coordinate of the array.

Where a large number of cells are to have discharges struck in them, the time taken to write a complete display depends on the duration of the pulses required to initiate each column of discharges. The pulse duration required is called the statistical delay and may be reduced by increasing the photoemission from the cathodes by 'flooding' or priming them with ultraviolet radiation.

In operation to ensure that all display cells are primed adequately for the pulse duration chosen, it is necessary to have a priming discharge in the vicinity of the cells of each character block or each line. Such priming discharge may be permanent, or intermittent in a scanned display panel, and may comprise one cell of a line permanently containing a discharge (shielded from view) the cathode glow of which provides ultraviolet radiation to effect priming of adjacent cells illumination of their cathodes. Such a priming cell will hereinafter be called "as herein defined".

In the sandwich construction normally employed for panels of the above described type the cathode electrodes lie adjacent the ends of cavities in the block. Surface imperfections prevent sealing of the cavities and allow circulation of the gas between cavities, and such gaps as exist permit the display cathodes to receive some UV from a nearby priming cell. However, the efficacy of the priming varies with the local gap width, and in general this is inadequate to provide satisfactory priming.

It is an object of the present invention to provide a gas discharge display panel permitting improved illumination of display cell cathodes by UV from a priming cell discharge.

According to the present invention a gas discharge display panel includes a block of electrically insulating material containing a plurality of gas filled cavities arranged in a two-coordinate array and an end plate attached to the block to seal off one of the ends of the cavities, the plate carrying on the face thereof adjacent the block a plurality of electrodes, each arranged to lie adjacent an associated cavity, and formed by a set of conductors, individual conductors of the set interconnecting the cavities associated with corresponding individual values of one coordinate of the array, a plurality of the conductors having parts forming electrodes of priming cells (as herein defined), and some or all of the conductors being formed along at least a part of their length to a greater thickness than at the locations of the priming cell electrodes so as to maintain a gap between said priming cell electrodes and the ends of their associated cavities to permit a discharge in the priming cell to extend into the gap and illuminate the parts of the conductors adjacent the cavities.

Where all of the cells of the display area are required to produce any form of display, all of the conductors may be thickened except for their priming cell electrodes. Alternatively all or some of the conductors may be thickened over part only of their length. Furthermore, some parts of the conductors, other than the priming cell electrodes, may be thickened to an intermediate value such that a gap exists between the display cell electrodes and their associated cavities which is smaller than the gap between the priming cell electrodes and their associated cavities. Such a variation in gaps permits different striking voltage ranges to be used for the priming and other cells.

Gas discharge display panels are frequently dedicated to the display of alphanumeric characters, that is, the only devices required for display are in subarrays of $7\times5$ cells, with one or more lines of cells being maintained between adjacent blocks to preserve separation of the characters displayed. Sometimes one cell of an intervening line is employed as a decimal point.

It is then convenient for the thickened conductors to occupy said intervening lines. Such thickened conductors on intervening lines need not have priming cell electrodes.

In a gas discharge display panel according to the present invention in which at least one line of priming cells comprise a glow transfer arrangement, and including a further end plate attached to the block to seal off the other ends of the cavities carrying on the face adjacent the block a plurality of further electrodes corresponding to the other ends of the cavities, some or all of the further electrodes not comprising electrodes of the glow transfer arrangement may be of such thickness as to locate positively within the ends of the cavities and displace the block from the further end plate to form a gap between the block and the remainder of the further electrodes on the further end plate.

The thickened conductors preferably are thicker than the other conductors by up to 0.05 mm. The conductors may be formed of thick film printed nickel or nickel plated on other thick film material.

Figure 2:
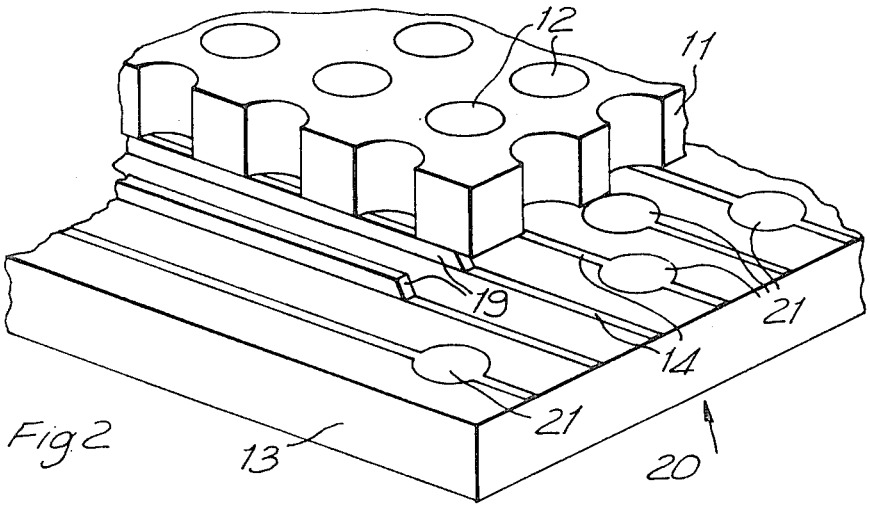
Figure 3:
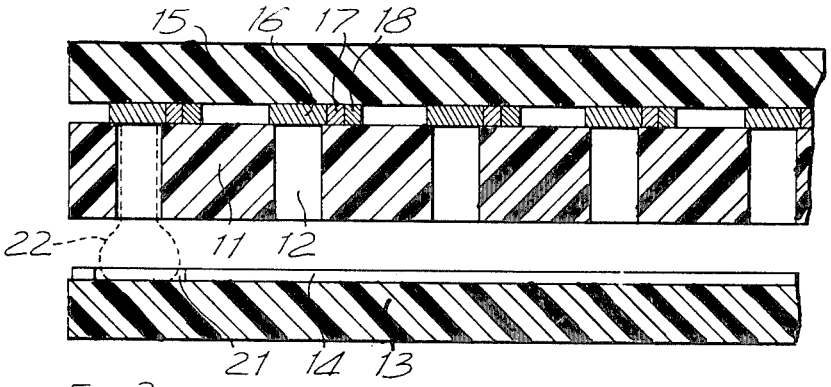
Figure 4:
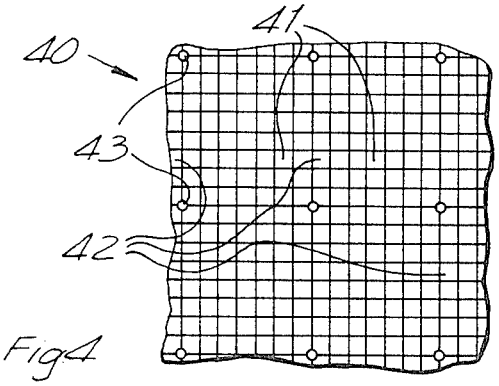
Figure 5:
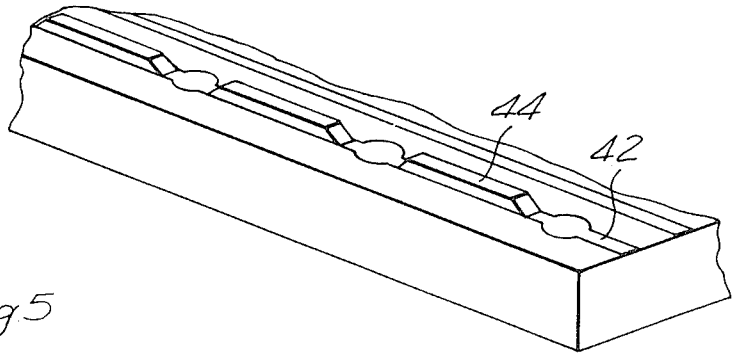
Figure 7:
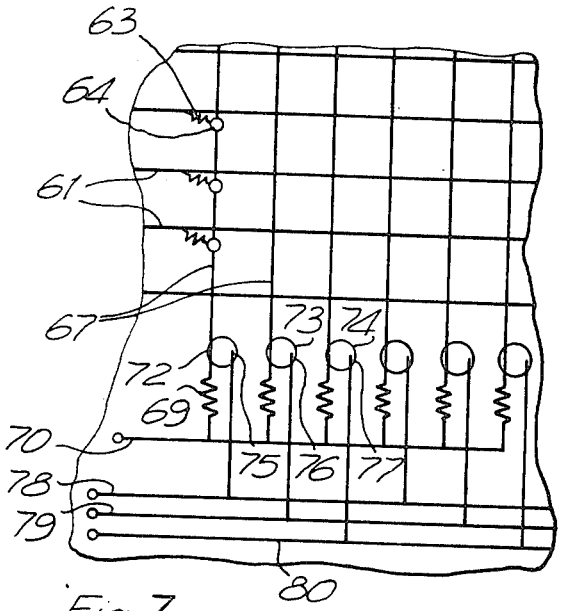
Figure 6:
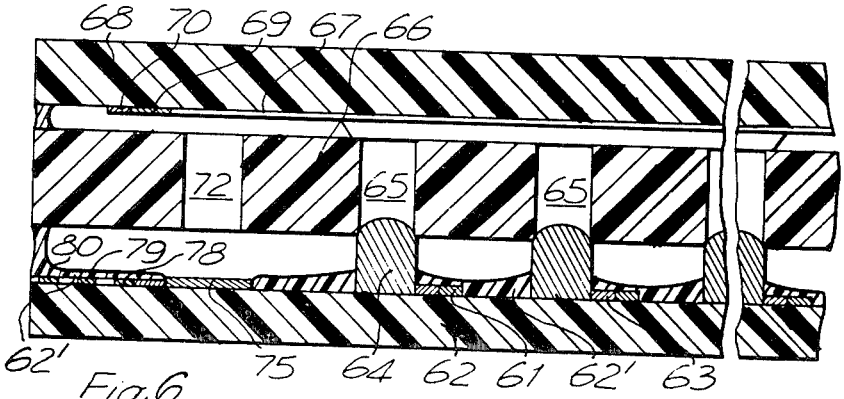

Embodiments of the invention will now be described by way of example with reference to the accompanying drawings, in which:

FIG. 1 is an exploded perspective view of a gas discharge display panel according to the present invention, FIG. 2 is a perspective partly sectioned view of the gas discharge display panel of FIG. 1 and showing details of the end plate, FIG. 3 is a sectional elevation through a device according to the invention to illustrate the principle of operation, FIG. 4 is a plan view of another form of end plate of a gas discharge display panel according to the present invention, FIG. 5 is a perspective view of the end plate of FIG. 4 showing the conductor formation, FIG. 6 is a sectional elevation through a self-scanning display panel to illustrate a further feature of the invention, and FIG. 7 is a schematic circuit arrangement of the display panel of FIG. 6.

Referring now to FIG. 1, a gas discharge display panel is constructed to provide two rows of alphanumeric characters. The panel comprises a block 11 of electrically insulating material containing a plurality of cavities in the form of a rectangular matrix of through apertures 12. An end plate 13 is arranged to close off one end of the apertures by being sealed around the periphery of the block. The end plate 13 carries on the face thereof adjacent the block a set of parallel conductors 14. The conductors 14 are so disposed that when the block and plate 13 are secured to each other the conductors 14 cross the ends of the cavities, those portions of the conductors overlying the ends of the cavities forming electrodes for the cells defined by the cavities. The conductors are divided into groups each of five ($c_1$, $c_2$, etc) for each alphanumeric character with two conductors 19 between each group to permit separation of characters.

A further end plate 15 is disposed adjacent the other face of the block and sealed to the periphery of the block to close off the other ends of the cavities. The plate 15 carries on the face adjacent the block a set of parallel conductors 18 extending orthogonally to conductors 14. Said face of the plate 15 also carries an array of electrodes 16, one for each cavity 12, arranged to overlay the end of the cavity. Each of the electrodes having a particular coordinate value is jointed by an individual resistor 17 to an associated conductor 18.

The conductors 18, which may be called row conductors, are divided into two groups of seven $R_1$ and $R_2$ so that two lines of alphanumeric characters separated by one row of cells can be displayed. Conductors 18' and associated electrodes are present at each edge of the plate to provide two rows of priming cells. Similarly the first column of electrodes is associated with a conductor 14' of the plate 13 to form a column of priming cells at the edge of the panel.

So far the panel is conventional in that to form a display of characters a retaining voltage, insufficient to strike a discharge but sufficient to maintain one, is applied between all the conductors of the plate 13 and those of the plate 15 in such a sense that electrodes 16 form anodes and the conductors 14 form cathodes. A negative-going pulse is applied to each conductor 14 in turn and a positive-going pulse is simultaneously applied to selected conductors 18 to raise the potential across coordinately addressed cells to a level at which a discharge is initiated, each pulse (called a half-pulse) being insufficient by itself to initiate a discharge.

However, to provide priming of the display cells by the aforementioned priming cells, in which cells discharges are maintained at all times, a deliberate gap is formed between the block and the plate 13 by providing raised or thickened portions of the conductors 14 between column sets as indicated at 19. Ultra-violet radiation from the cathodes thereof can then permeate the small gap between the block 11 and plate 13 and illuminate the display cathodes.

A sectioned perspective view of such an end plate arrangement is shown in FIG. 2, there being a thickened portion 19 of the conductors 14 between each character block, that is, every sixth and seventh conductor.

It will be appreciated that where it is desired to operate the display panel with the priming cells continuously lit, the discharges in the priming cells should be shielded from a viewer of the panel so as not to interfere with the display. In general the panel is operated so as to be viewed in the direction of the arrow 20, the conductors 14 forming cathode electrodes where they cross ends of cavities and around the sides of which the cathode glows of discharges in the cavities can been seen. To prevent display of the cathode glow of the priming cells the conductors 14, where they form cathodes of the priming cells, are enlarged as at 21 so as to cover the end of the cavity and block the passage of light therefrom to the plate 13.

When the plate 13 is displaced from the block 12 by the thickened conductor portions 19, the priming cell cathodes 21 are required to be slightly larger to prevent escape of light. In a practical device the cavities 12 may be of 0.02 inches diameter with the centres on a 0.03 inch pitch such that to provide a cathode of adequate dimensions the cathode may require to be at least 0.03 inch. To permit priming cathodes to be provided on adjacent conductors 14 and without touching each other, cathodes on alternate conductors are staggered between two adjacent rows of cavities as shown.

An alternative method of blocking light from priming cells is by obscuring the plate 12 with paint or the like. However, the provision of enlarged cathodes is preferred as the operating life of the priming cells is improved by a lower current density for the cells provided by a larger cathode area.

FIG. 3 shows a sectional elevation through a display panel illustrating the effects of the separation between the block 11 and plate 13. Th cathode glow, the boundary of which is shown by broken line 22, is partly out of the cavity of the discharge cell and ultraviolet radiation from the discharge can more easily pass along the gap and strike the remaining parts of the conductor 14 adjacent the ends of the cavities to prime the cathode electrodes. Also the large area of each priming cathode shields the visible discharge from the viewer.

The construction described above with reference to FIGS. 1 to 3 for a particular form of panel may be varied in accordance with the present invention. FIG. 4 is a plan view of a panel 40 for displaying several rows of alphanumeric characters at locations 41 formed by the intersection points of conductors of the panel. In this construction, cathode conductors 42 between display areas are provided with an enlarged cathode electrode 43 adjacent each area as part of a priming cell which serves to provide UV priming of the cathodes of the associated area. Referring to FIG. 5, the conductors 42 are formed with raised or thickened portions 44 between the priming cathodes to separate the plates and the block and facilitate better priming.

A further construction incorporating the present invention concerns a self-scanning display panel as described in copending application No. Ser. No. 860,638. A sectional elevation through such a panel, and a circuit representation thereof, are shown in FIGS. 6 and 7 respectively.

The display panel comprises a set of row, or anode, conductors 61 carried by an end plate 62 each connected by way of a resistive element 63 to an anode electrode 64 adjacent one end of a cavity 65 in a block 66. All the elements other than the electrodes 64 are covered by an insulating layer 62'. A set of column, or cathode, conductors 67 carried by another end plate 68 crosses the other ends of the cavities 65, the conductors themselves forming the cathode electrodes as described for conductor 14 with reference to FIGS. 1 to 5. Each cathode conductor 67 is connected by way of an individual resistor 69 to a common conductor 70.

At least one line of cells of the array is devoted to the self-scanning cells of the panel, these being represented by those shown at 72, 73, 74. The cathode conductors 67 each comprise one of the electrodes of individual cells and the other electrodes are formed by conductors 75, 76, 77. These are connected to scanning supply conductors 78, 79, 80, respectively. In operation common conductor 70 is connected to earth and a discharge maintaining potential is applied to anode conductors 61. A positive-going pulse is applied to selected anode conductors as a negative-going pulse is applied to conductor 78. A discharge forms across the first scanning cell 72 (the conductor 67 acting as an anode and electrode 75 as a cathode) to reduce the potential on the conductor 67 to a negative value and permit the display cells of the selected anodes to strike. A next pulse is applied to selected conductors 61 as a pulse is applied to conductor 79. Even though other conductors are connected to supply conductor 79 a discharge strikes in the second cell 73 because of the mechanism of glow transfer based on priming of an adjacent electrode by a discharge. This is repeated for each column of the display by cyclic energisation of supply conductors 78, 79, 80. To remove a discharge opposite polarity, that is, positive going, pulses are applied to lines 78, 79, 80, the conductors 67 then acting as cathodes and the potential being raised with respect to conductors 61. Thus in certain modes of operation the roles of the conductors 67 and 75, 76, 77 may be reversed and a gap between the two electrodes of the scanning cell is desirable for efficient priming of the display electrodes.

This is achieved for the cathode conductors by means of the raised portions described with reference to FIGS. 1 to 3, and for the anode electrode by making each electrode in the form of a tapering protrusion such that the anodes extend partly into the cavities, the block 66 being located by them and spaced from the plate 62 carrying them so that the scanning conductor 75 is displaced from the cavity. This further has the advantage of confining each display discharge to the relevant cavity and avoiding cross talk. It will be seen that whichever electrode 67 or 75 of the scanning cell is the cathode, the cathode of the adjacent cell is always irradiated, and when the scanning pulse is switched between scanning conductors said adjacent cell strikes a discharge in preference to any others. The conductors, particularly the display anodes 64, may be formed of thick film printed nickel. It will be appreciated that although in all of the above described embodiments the cathode electrodes have been integral parts of the cathode conductors, they may be formed separately and connected to the conductors 14 electrically.

What I claim is:

1. A gas discharge display panel including a block of electrically insulating material containing a plurality of gas filled cavities forming display cells arranged in a two-coordinate array, each line of cavities including a priming cell containing a discharge for providing ultraviolet radiation to effect priming of adjacent display cells, a first end plate attached to the block to seal off one end of each of said cavities, the plate carrying on one face thereof adjacent the block a set of conductors extending along one coordinate of the array and associated one each with lines of cavities to form electrodes of discharge cells contained in said cavities, the conductors having thickened parts extending across the ends of the cavities of display cells to space the end plate from the block so that the parts of the conductors associated with the cavities of the priming cells are spaced from the ends of the cavities enabling radiation from a priming cell discharge extending into the space to illuminate the sides of adjacent conductors, a second plate attached to the block to seal off the other ends of the cavities and carrying on one face thereof adjacent the block a plurality of further electrodes corresponding to other ends of the cavities, and a further set of conductors extending along the other co-ordinate of the array associated one each with lines of cavities connected to said further electrodes by way of resistive elements.

2. A gas discharge, display panel as claimed in claim 1 in which the thickened parts of the conductors are all thickened to the same extent.

3. A gas discharge display panel as claimed in claim 1 in which the parts of the conductors forming priming cell electrodes are of greater area than the priming cell cavities to block light from the priming discharge from passage through the first end plate.

4. A gas discharge display panel as claimed in claim 1 in which at least one line of cells comprises a glow transfer arrangement and in which at least some of the further electrodes, not comprising electrodes of the glow transfer arrangement, are of such thickness as to locate positively within the ends of the cavities and space the block from the further end plate to form a gap between the block and the remainder of the further end plate.

5. A gas discharge display panel as claimed in claim 1 in which the thickened parts are thicker than the unthickened parts by up to 0.05 millimeters.

6. A gas discharge display panel as claimed in claim 1 in which the conductors are formed of thick film printed nickel.

7. A gas discharge display panel as claimed in claim 1 in which the conductors are nickel plated.

* * * * *